US007090501B1

(12) United States Patent
Scherer et al.

(10) Patent No.: US 7,090,501 B1
(45) Date of Patent: Aug. 15, 2006

(54) CONNECTOR APPARATUS

(75) Inventors: Richard J. Scherer, Austin, TX (US); Jerome P. Dattilo, Cedar Park, TX (US); Frank J. Cuzze, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/086,829

(22) Filed: Mar. 22, 2005

(51) Int. Cl.
*H01R 12/00* (2006.01)

(52) U.S. Cl. ..... 439/61; 361/65; 361/108; 361/109; 361/74; 361/78

(58) Field of Classification Search ..... 439/74, 439/76, 61, 84, 865, 608
See application file for complete search history.

(56) References Cited

U.S. PATENT DOCUMENTS

| | | | | |
|---|---|---|---|---|
| 3,601,750 | A * | 8/1971 | Mancini | 439/84 |
| 3,789,271 | A | 1/1974 | Johnston | |
| 4,674,812 | A * | 6/1987 | Thom et al. | 439/78 |
| 4,686,607 | A | 8/1987 | Johnson | |
| 4,917,616 | A | 4/1990 | Demier, Jr. et al. | |
| 4,941,831 | A | 7/1990 | Tengler et al. | |
| 5,045,975 | A | 9/1991 | Cray et al. | |
| 5,054,192 | A | 10/1991 | Cray et al. | |
| 5,055,054 | A | 10/1991 | Doutrich | |
| 5,195,237 | A | 3/1993 | Cray et al. | |
| 5,316,487 | A * | 5/1994 | Clark | 439/78 |
| 5,411,409 | A | 5/1995 | Gray et al. | |
| 5,527,189 | A | 6/1996 | Middlehurst et al. | |
| 5,620,340 | A | 4/1997 | Andrews | |
| 6,113,397 | A | 9/2000 | Myers | |
| 6,146,202 | A | 11/2000 | Ramey et al. | |
| 6,231,391 | B1 | 5/2001 | Ramey et al. | |
| 6,368,120 | B1 | 4/2002 | Scherer et al. | |
| 6,371,813 | B1 * | 4/2002 | Ramey et al. | 439/608 |
| 6,545,226 | B1 | 4/2003 | Brodsky et al. | |
| 6,602,078 | B1 | 8/2003 | Kwark | |
| 6,639,154 | B1 * | 10/2003 | Cartier et al. | 174/255 |
| 6,912,780 | B1 * | 7/2005 | Chamberlin et al. | 29/853 |
| 2005/0009415 | A1 * | 1/2005 | Johnson | 439/865 |

FOREIGN PATENT DOCUMENTS

| | | |
|---|---|---|
| EP | 0 374 307 A1 | 6/1990 |
| EP | 0584902 A1 | 3/1994 |
| EP | 1 049 201 A1 | 11/2000 |

* cited by examiner

*Primary Examiner*—Tulsidas C. Patel
*Assistant Examiner*—Harshad C Patel
(74) *Attorney, Agent, or Firm*—Melanie G. Gover

(57) ABSTRACT

A connector system includes a circuit board having a plurality of holes extending therethrough. First and second connector bodies, each having a front wall, are positioned on first and second sides of the circuit board, respectively. The front walls of the connector bodies have a plurality of signal pin openings aligned with the circuit board holes. A plurality of signal pins extend through the signal pin openings of the first and second connector bodies and through the circuit board holes. At least one of the plurality of circuit board holes has a diameter larger than a diameter of the signal pin extending therethrough, such that walls of the at least one circuit board hole are spaced apart from the signal pin extending therethrough.

34 Claims, 6 Drawing Sheets

CONNECTOR APPARATUS

BACKGROUND

This invention relates to electrical connectors, and particularly to high-speed electrical connectors for attachment to printed circuit boards.

Electrical conductors carrying high-frequency signals and currents are subject to interference and cross-talk when placed in close proximity to other conductors carrying high-frequency signals and currents. The interference and cross-talk can result in degradation of the signal and errors in signal reception. Coaxial and shielded cables are available to carry signals from a transmission point to a reception point, and reduce the likelihood that the signal carried in one shielded or coaxial cable will interfere with the signal carried by another shielded or coaxial cable in close proximity. However, at points of connection, the conductor shielding is often lost. The loss of shielding allows interference and crosstalk between signals near the points of connection. The use of individual shielded wires and cables is not desirable at points of connection due to the need for making a large number of connections in a very small space. In these circumstances, two-part high-speed backplane electrical connectors containing multiple shielded conductive paths are used. For example, specification IEC 1076-4-101 from the International Electrotechnical Commission sets out parameters for 2 mm, two-part connectors for use with printed circuit boards.

As users modify and upgrade systems to achieve improved performance, problems continue to arise. In particular, with many high-frequency systems, even a small unshielded portion of an electrical conductor causes a discontinuity in the impedance of the conductor, and allows performance damaging interference and cross-talk to occur. A connector system that provides improved shielding and impedance control is desirable.

SUMMARY

One aspect of the invention described herein provides a connector system. In one embodiment according to the invention, the connector system includes a circuit board having a plurality of holes extending from a first side of the circuit board to a second side of the circuit board. A first connector body having a front wall is positioned on the first side of the circuit board, and the front wall has a plurality of signal pin openings extending therethrough, the signal pin openings aligned with the circuit board holes. A second connector body having a front wall is positioned on a second side of the circuit board, and the front wall has a plurality of signal pin openings extending therethrough, the signal pin openings aligned with the circuit board holes. A plurality of signal pins extend through the signal pin openings of the first and second connector bodies and through the circuit board holes. At least one of the plurality of circuit board holes has a diameter larger than a diameter of the signal pin extending therethrough, such that walls of the at least one circuit board hole are spaced apart from the signal pin extending therethrough.

In another embodiment according to the invention, the connector system includes a circuit board having a plurality of holes extending therethrough, the holes having electrically conductive walls. A connector body is attached to the circuit board and has a plurality of signal pin openings and a plurality of shield blade openings, the signal pin openings aligned with the circuit board holes. A plurality of signal pins are retained in the plurality of signal pin openings of the connector body and extend through the circuit board holes. A plurality of shield blades are retained in the plurality of shield blade openings of the connector body. Each of the plurality of shield blades has at a first end thereof a generally right angle shielding portion disposed adjacent a corresponding one of the plurality of signal pins. The circuit board holes are dimensioned such that the electrically conductive walls are spaced apart from the signal pins extending therethrough.

Another aspect of the invention described herein provides a method of mounting a connector system to a circuit board. In one embodiment according to the invention, the method includes forming a plurality of holes extending from a first side of the circuit board to a second side of the circuit board. A first connector body is attached to the first side of the circuit board, the first connector body having a plurality of signal pin openings aligned with the circuit board holes. A second connector body is attached to the second side of the circuit board opposite the first connector body, the second connector body having a plurality of signal pin openings aligned with the circuit board. Signal pins are passed through the aligned circuit board holes and signal pin openings of the first and second header bodies, wherein the circuit board holes are sized such that walls of the circuit board holes are spaced apart from the signal pins.

DETAILED DESCRIPTION

In the following detailed description of the preferred embodiments, reference is made to the accompanying drawings, which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
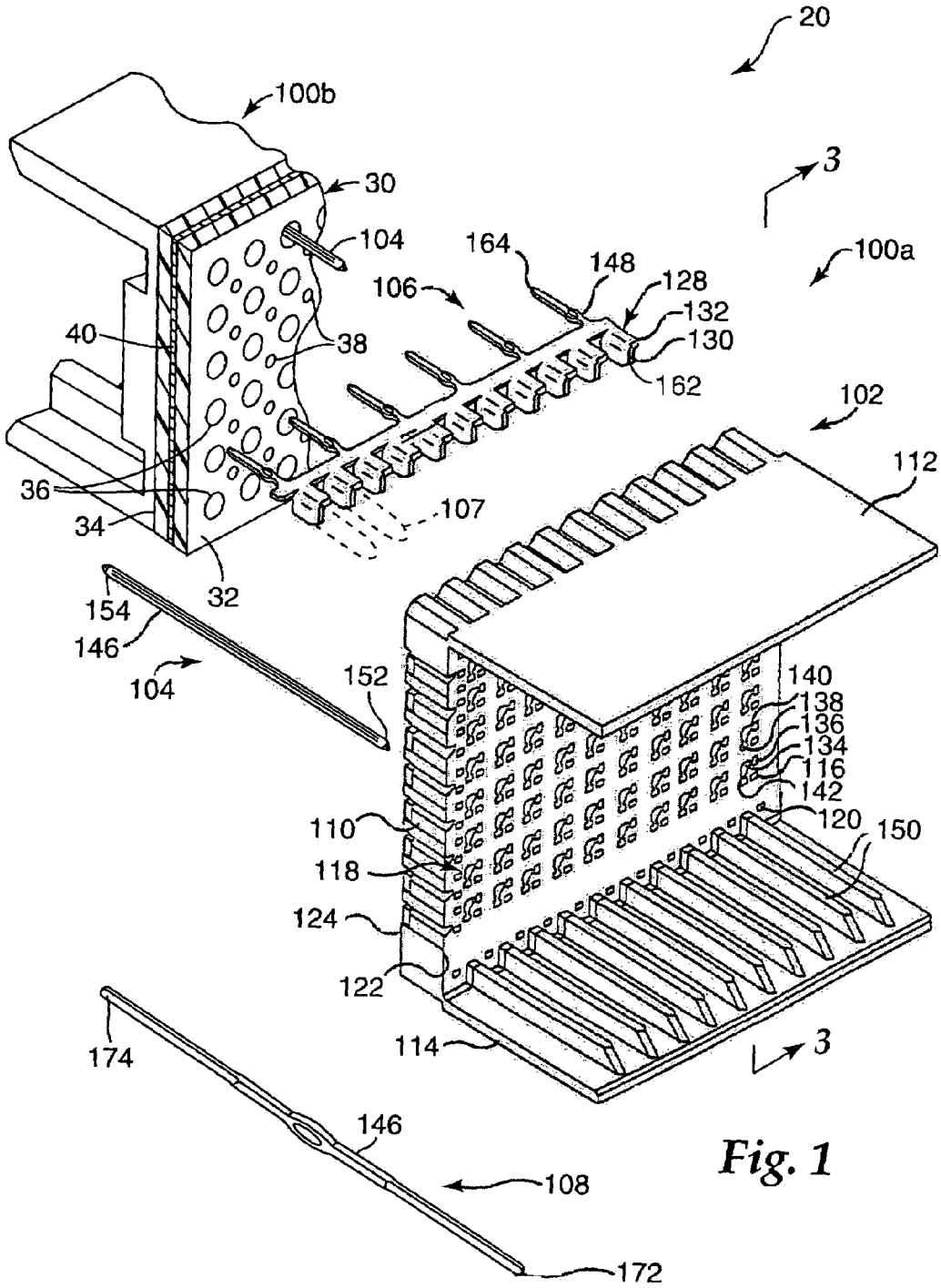
FIG. 1 is a partially exploded perspective view of one embodiment of a connector system in accordance with the invention.
Figure 2:
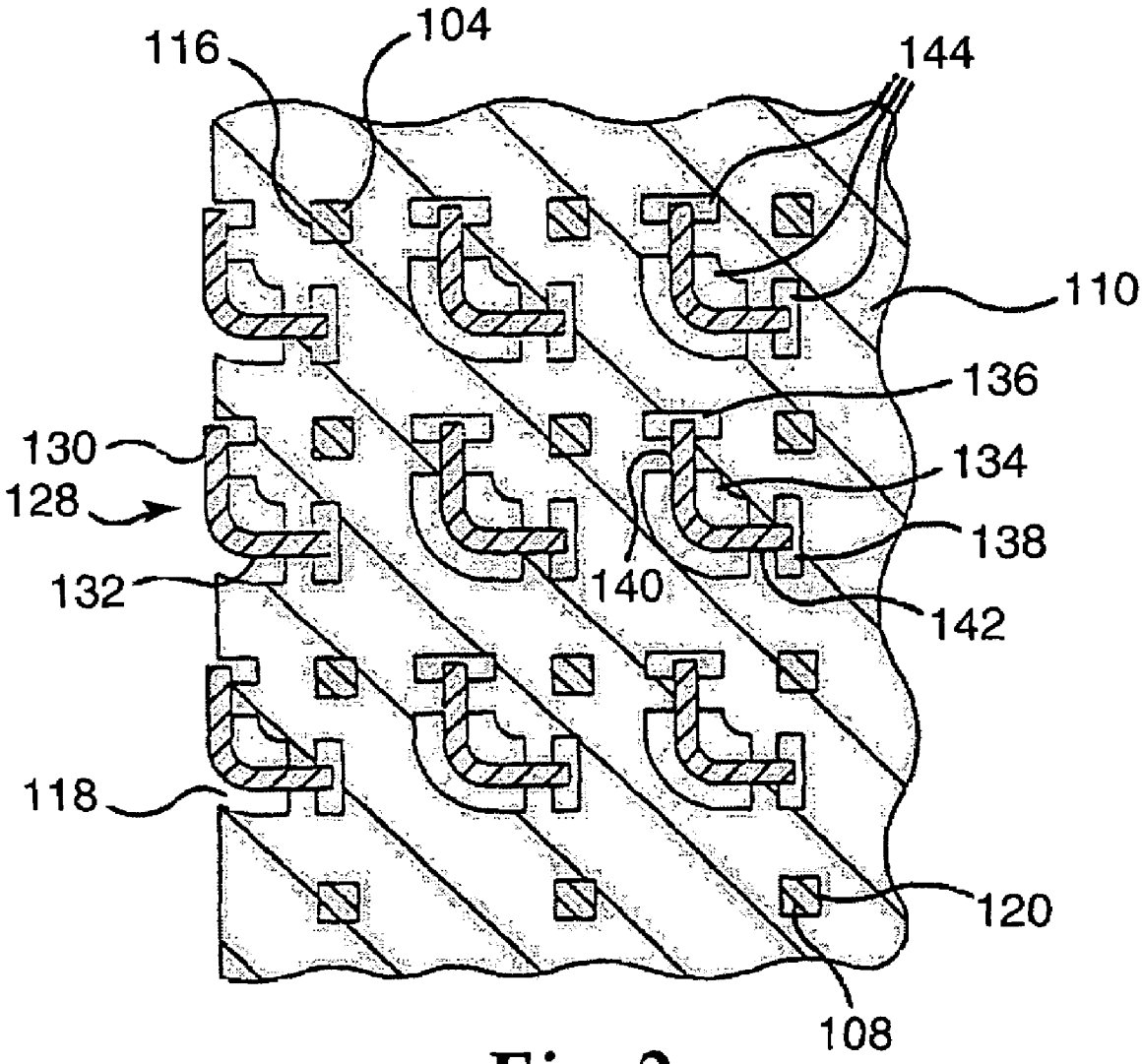
FIG. 2 is a cross-sectional view of the front wall of a header connector from the connector system of FIG. 1, illustrating signal pins surrounded by right angle portions of the shield blades forming coaxial shields around each signal pin.
Figure 3:
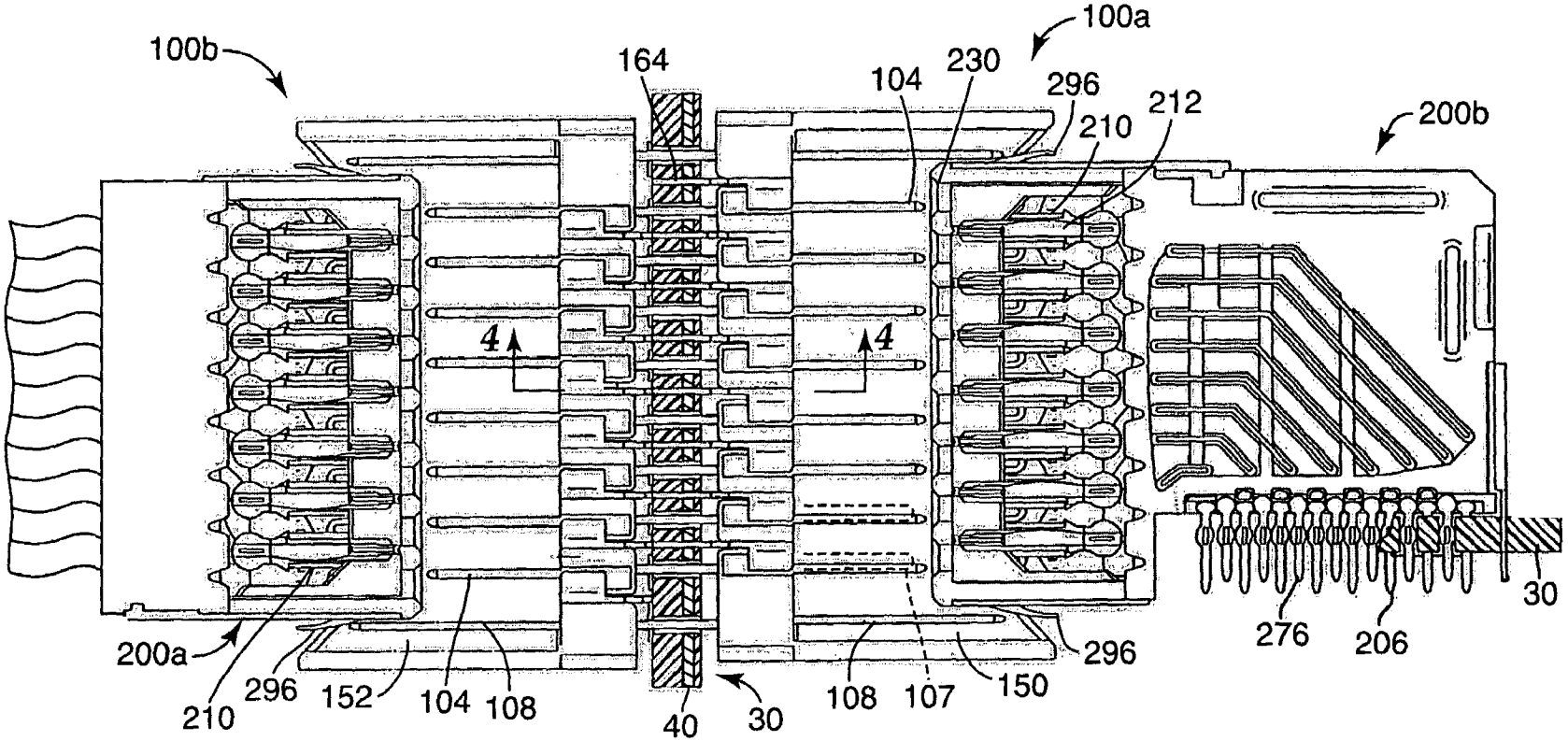
FIG. 3 is a partial cross-sectional view of the connector system taken along line 3—3 of FIG. 1, showing two socket connectors partially inserted into the header connectors on opposite sides of a printed circuit board.

FIGS. 1 and 2 show one embodiment of a connector system 20 in accordance with the present invention. The connector system 20 includes a printed circuit board 30, a first header connector 100*a* on a first side 32 of the printed circuit board 30, and a second header connector 100*b* on a second side 34 of the printed circuit board 30. First and second header connectors 100*a*, 100*b* are configured for attachment to printed circuit board 30, and are positioned back-to-back on opposite sides 32, 34 of printed circuit board 30. The first and second header connectors 100*a*, 100*b* are each further configured for connection to a mating socket connector (FIG. 3). The socket connector may be configured for connection to a cable (socket connector 200*a*) or another printed circuit board (socket connector 200*b*), for example.

Each header connector 100*a*, 100*b* includes a connector body 102 configured to receive a plurality of signal pins 104 and a plurality of shield blades 106 therein. The connector bodies 102 may also be configured to receive optional ground pins 108. The signal pins 104 are straight pins, and are retained within connector body 102 by press-fit. In one embodiment, at least two or more of the shield blades 106 are formed from a continuous strip of material. In one embodiment, except for their length, the ground pins 108 are substantially identical to the signal pins 104. In another embodiment, the ground pins 108 are configured to be retained by press-fit in the printed circuit board 30.

The connector body 102 of each header connector 100*a*, 100*b* includes a front wall 110 and laterally-extending side walls 112, 114 projecting perpendicularly therefrom. The front wall 110 includes a plurality of signal-pin-receiving openings 116, a plurality of shield-blade-receiving openings 118, and a plurality of ground-pin-receiving openings 120, all of which extend between an internal surface 122 and an external surface 124 of front wall 110. In one embodiment, the plurality of shield-blade-receiving openings 118 are formed to have a generally right angle cross-section, matching the cross-section of the shield blades 106. In one embodiment, the openings 116, 118, 120 include chamfered entrances at one or both of internal surface 122 and external surface 124 to assist in the insertion of pins 104, 108 and shield blades 106. The openings 116, 118, 120 are sized to receive signal pins 104, shield blades 106, and ground pins 108 in either a press-fit or slip-fit manner, as required by the particular application. In some embodiments, pins 104, 108 are retained by press-fit in one header connector 100*a*, and retained by slip-fit in the other header connector 100*b*.

When header connectors 100*a*, 100*b* are mounted on opposite sides 32, 34 of printed circuit board 30, each signal-pin-receiving opening 116 is aligned with a corresponding signal pin hole 36 extending through printed circuit board 30. As described in greater detail below, a portion or all of signal pin holes 36 have a diameter larger than the diameter of an associated signal pin 104 extending through the hole. In one embodiment, each signal-pin-receiving opening 116 of header connectors 100*a*, 100*b* is coaxially aligned with a corresponding signal pin hole 36. The signal pins 104 are configured for insertion into corresponding signal-pin-receiving openings 116 in the header connectors 100*a*, 100*b*, and have a length sufficient to allow pins 104 to extend continuously through first header connector 100*a*, signal pin hole 36 in printed circuit board 30, and second header connector 100*b* to form an array of signal pins 104 on both sides of printed circuit board 30. Each signal pin 104 thus includes a first end 152 extending above the front wall 110 of the first header connector 100*a*, and a second end 154 extending above the front wall 110 of the second header connector 100*b*. In one embodiment, the array of signal pins 104 is configured for reception in an array of pin-insertion windows 230 in mating socket connector 200 (FIG. 3), when a socket connector 200 is inserted into at least one of the header connectors 100*a*, 100*b*.

The plurality of shield blades 106 are formed to include a generally right angle shielding portion 128 configured to be inserted into the plurality of generally right angle shield-blade-receiving openings 118. The generally right angle shielding portion 128 of each of the plurality of shield blades 106 includes substantially perpendicular first leg portion 130 and second leg portion 132. Each shield blade 106 includes a first end 162 and a second end 164. In one embodiment, when shield blades 106 are inserted into connector body 102, the first end 162 of shield blade 106 extends to the plane of internal surface 122 of the front wall 110 of the header connectors 100*a*, 10*b*, adjacent to a signal pin 104, such that first end 162 is substantially coplanar with internal surface 122. In another embodiment, when shield blades 106 are inserted into connector body 102, the first end 162 of shield blade 106 extends above the plane of internal surface 122 of the front wall 110 of the header connectors 100*a*, 100*b* for connection to a shielded socket connector, as illustrated by dashed lines 107 in FIGS. 1 and 3. In the latter embodiment, the mating socket connector 200 may have relief areas to receive the extended shield blades 107.

Each strip of shield blades 106 includes at least one shield tail 148 configured for insertion into a corresponding ground hole 38 in the printed circuit board 30. When the signal pins 104 and shield blades 106 are inserted into the front wall 110 of the connector body 102, the shield tails 148 extend outwardly from the external surface 124 of the front wall 110. The shield tails 148 of headers 100*a*, 100*b* can be either press fitted into ground holes 38 in the printed circuit board 30 or soldered thereto. Alternatively, the shield tails 148 could be surface mounted to the printed circuit board 30. In one embodiment, shield tails 148 of shield blades 106 are electrically connected to a ground plane 40 within printed circuit board 30. In one embodiment shield blades 106 are commonly grounded. In another embodiment, shield blades 106 are not commonly grounded. In one embodiment, at least one signal pin 104 is electrically connected with ground plane 40 and commonly grounded with at least one shield blade 106 via the ground plane 40.

Figure 4:
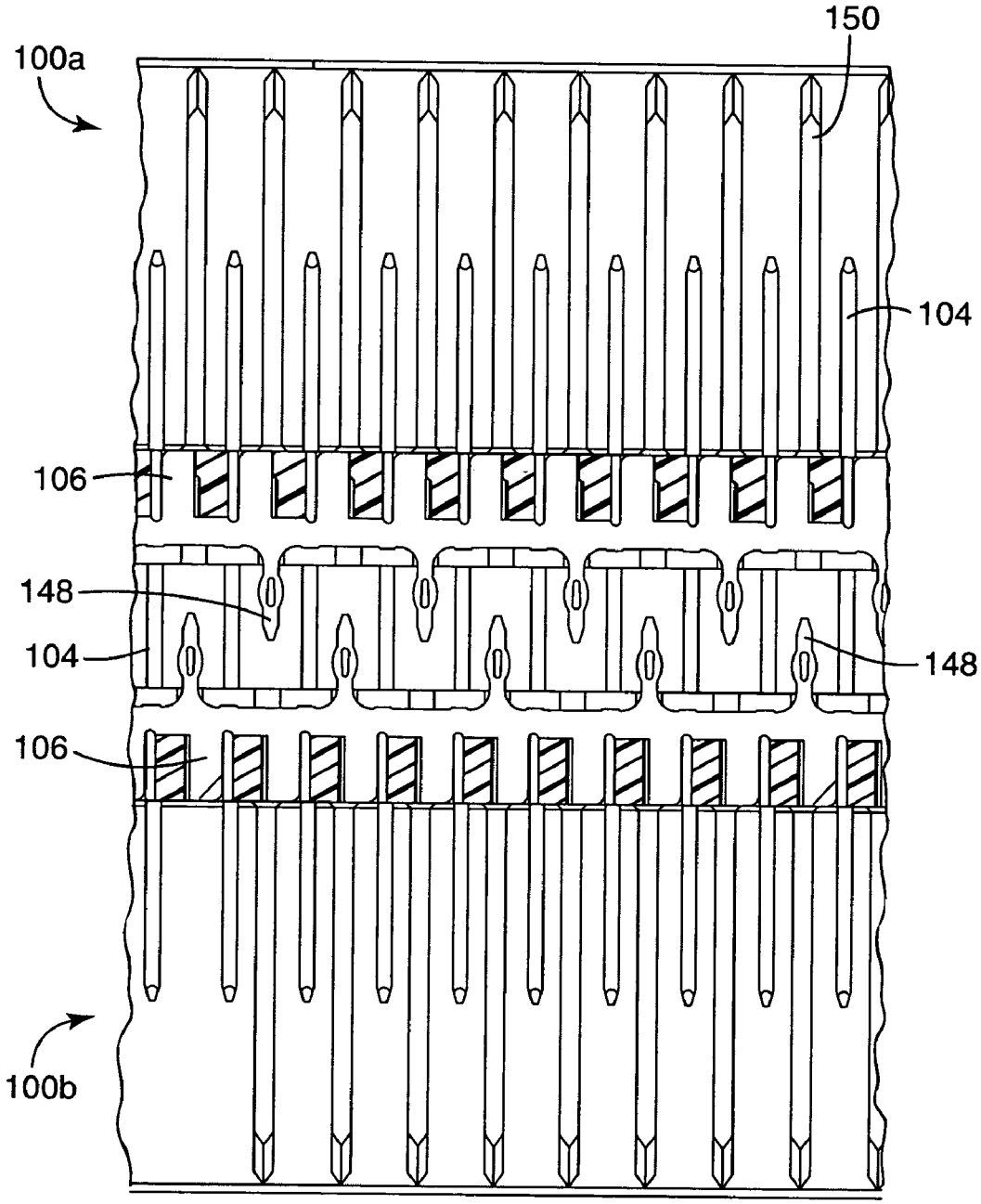
FIG. 4 is a cross-sectional view taken along line 4—4 in FIG. 3 showing the staggered tails of the shield blades.
Figure 5:
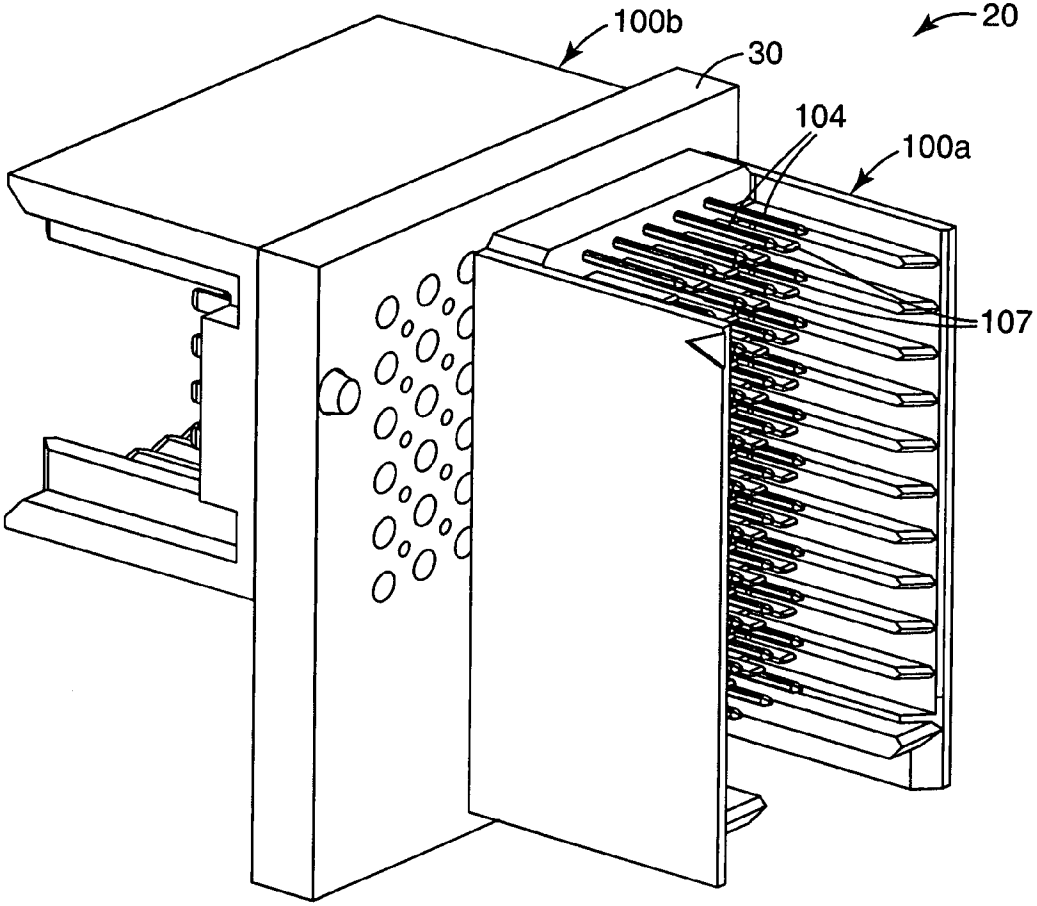
FIG. 5 is a perspective view showing headers of the connector system mounted orthogonally to each other on opposite sides of a printed circuit board.

The number of shield tails 148 may be the same as the number of shield blades 106, or may be different than the number of shield blades 106. In one embodiment, each strip of shield blades 106 has a plurality of shield tails 148, with one shield tail 148 for every two shield blades 106, wherein the shield tails 148 are staggered and aligned with alternate shield blades 106 along the strip of shield blades 106. In other embodiments, other ratios of shield tails 148 to shield blades 106 may be provided, with the shield tails 148 either uniformly or non-uniformly spaced along the length of the strip of shield blades 106. Embodiments having staggered shield tails 148 on shield blades 106 are particularly useful in back-to-back mounting of header connectors 100*a*, 100*b* on printed circuit board 30, as the staggered shield tails 148 permit back-to-back mounting of header connectors 100*a*, 100*b* without interference between shield tails 148 of the opposing header connectors 100*a*, 100*b* (FIG. 4). In one embodiment, shield tails 148 are positioned in an evenly spaced matrix, such that back-to-back mounted header connectors 100*a*, 100*b* may be mounted orthogonally to each other, if desired for a particular application (FIG. 5).

As best seen in FIG. 2, the signal-pin-receiving openings 116 and the shield-blade-receiving openings 118 are arranged symmetrically in the front wall 110 of the connector body 102 such that the generally right angle shielding portions 128 of shield blades 106 substantially surround the signal pins 104 to form a coaxial shield around each of the plurality of signal pins 104. Each of the plurality of generally right angle shield-blade-receiving openings 118 includes a central portion 134 coupled to first and second end portions 136 and 138 by first and second narrowed throat portions 140 and 142. The first and second narrowed throat portions 140 and 142 are dimensioned to frictionally engage the first and second leg portions 130 and 132 of the shield blades 106 to hold the shield blades 106 in place within the connector body 102. The central portion 134 and the first and second end portions 136 and 138 of each of the plurality of generally right angle openings 118 are formed to provide air gaps 144 surrounding the generally right angle shield portion 128 of a shield blade 106. The geometry and dimensions of the air gaps 144, the geometry, dimensions and material of the right angle shielding portions 128, and the geometry, dimensions and material of the connector body 102 surrounding the air gaps 144 are configured to tune the header connectors 100*a*, 100*b* to match a specified impedance (for example, 50 ohms). The configuration of the right angle shield blades 106 lends itself to mass production in a continuous strip in a manner that economizes material usage.

Figure 6A:
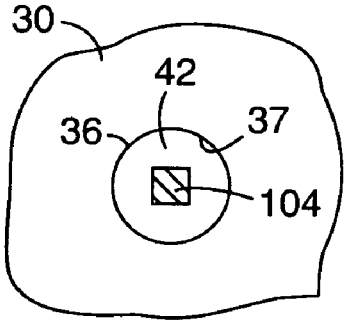
FIGS. 6A–6F are schematic cross-sectional views of a plurality of embodiments of signal pins extending through a printed circuit board according to the invention.

In one embodiment illustrated in FIG. 6A, at least one signal pin hole 36 in printed circuit board 30 is dimensioned such that walls 37 of the signal pin hole 36 are spaced apart from the associated signal pin 104 passing through the signal pin hole 36. That is, an air gap 42 is provided between the signal pin 104 and the walls 37 of its respective signal pin hole 36. In another embodiment, the signal pin holes 36 associated with each of the plurality of signal pins 104 are dimensioned such that walls 37 of the holes 36 are spaced apart from the associated signal pins 104. The geometry and dimensions of the signal pin holes 36, and the geometry and dimensions of the signal pins 104 extending therethrough are selected to tune the impedance of the connector system 20 between the first and second sides 32, 34 of the printed circuit board 30, and thereby match the impedance on the first and second sides 32, 34 of the printed circuit board 30. For example, the dimensions of the signal pin holes 36 and signal pins 104 (and thus the size of the air gap between walls 37 and signal pins 104) may be selected such that the impedance of the system between the first and second sides 32, 34 of the printed circuit board 30 matches the impedance of the header connectors 100*a*, 100*b* (for example, 50 ohms).

Figure 6B:
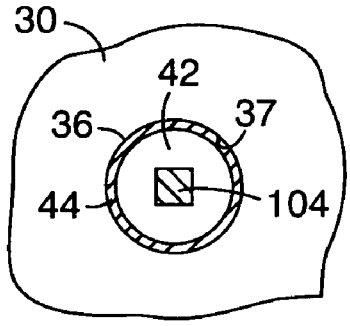
Figure 6C:
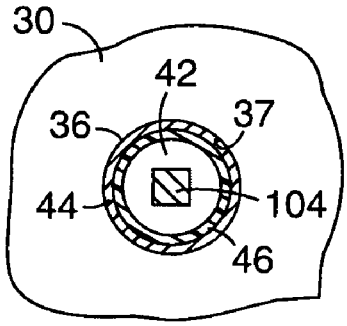
Figure 6D:
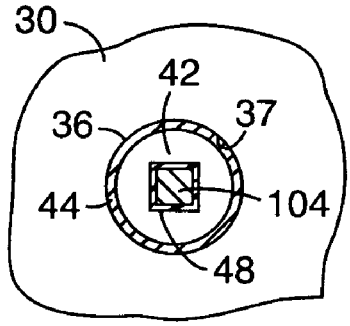
Figure 6E:
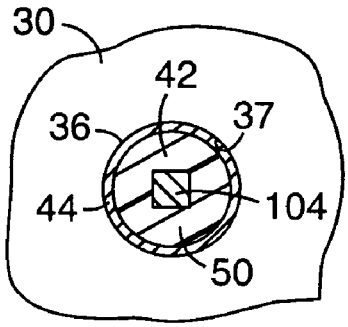

In one embodiment illustrated in FIG. 6B, the walls 37 of the signal pin holes 36 are made to be electrically conductive, such as by plating the walls 37 with a conductive material 44. In one embodiment, the electrically conductive walls 37 are electrically connected to a common ground on the circuit board 30. In one embodiment, the common ground comprises a ground plane 40 within printed circuit board 30. When the walls 37 are electrically conductive, a dielectric material other than air may be positioned between the walls 37 and the signal pin 104 extending therethrough. In one embodiment illustrated in FIG. 6C, the dielectric material comprises a dielectric coating 46 covering the conductive material 44 on walls 37 of the circuit board hole 36. In another embodiment illustrated in FIG. 6D, the dielectric material comprises a dielectric coating 48 on the signal pin 104. In yet another embodiment illustrated in FIG. 6E, the dielectric material comprises a dielectric sleeve 50. The dielectric sleeve 50 may be slip-fit around the signal pin 104, or slip fit within the signal pin hole 36. The dielectric sleeve 50 may occupy all or only a portion of the space between the signal pin 104 and the conductive wall 37. Although signal pin 104 is illustrated in FIGS. 6A–6E as having a rectangular cross-sectional shape, signal pin 104 may have other cross-sectional shapes, including circular.

Figure 6F:
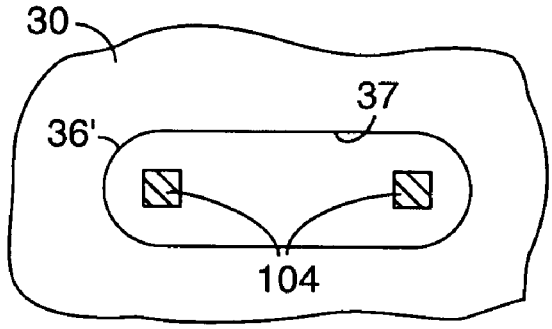

In one embodiment, two adjacent signal pin holes 36 are merged, such that an elongated oval shaped signal pin hole 36' is formed (FIG. 6F). Two signal pins 104 extend through the oval shaped signal pin hole 36' and create a differential pair signal capability. As described with respect to FIGS. 6A–6E, in various embodiments walls 37 of the oval shaped signal pin hole 36' may be made electrically conductive by covering with an electrically conductive material, dielectric coatings may be applied to the walls 37 or to signal pins 104, or dielectric sleeves may be positioned to occupy all or only a portion of the space between the signal pin 104 and the conductive wall 37 of oval shaped signal pin hole 36'.

In one embodiment, a plurality of ground pins 108 are configured for insertion into the plurality of ground-pin-receiving openings 120 in the front wall 110 of the header connector 100. The plurality of ground pins 108 are configured to engage contact arms 296 of corresponding grounding structures of socket connectors 200*a*, 200*b* when the socket connectors 200*a*, 200*b* are inserted into the header connector 100 as shown in FIG. 3. Each ground pin 108 includes a first end 172 extending above the front wall 110 of the header connector 100*a*, and a second end 174 spaced apart from the first end 172 and configured for insertion through a ground hole 38 in printed circuit board 30, where electrical contact with ground plane 40 is optionally provided. If socket connectors 200*a*, 200*b* do not include or require a grounding contact, ground pins 108 may be omitted from headers 100*a*, 100*b*.

Socket connectors 200*a*, 200*b* may be any of a variety of connector types, such as connectors configured for connection to a printed circuit board (socket connector 200*b*) or a cable connector (socket connector 200*a*). In one embodiment according to the invention, socket connectors 200*a*, 200*b* are hard metric connectors according to industry standard IEC 61076-4-101. In another embodiment, socket connectors 200*a*, 200*b* are a hard metric connector according to the CompactPCI® or FutureBus® industry standards. In each embodiment, socket connectors 200*a*, 200*b* includes a plurality of signal contacts 210 for making electrical contact with the array of signal pins 104 of the header connectors 100*a*, 100*b*, and at least one shielding element 212 associated with the plurality of signal contacts 210. In one embodiment, the at least one shielding element 212 of the socket connectors 200*a*, 200*b* comprises a plurality of strip line shielding elements associated with the plurality of signal contacts 210. When configured to mate with a printed circuit board, socket connector 200*b* may be provided with signal tails 206 and shield tails 276 that can be either press fitted into holes in a printed circuit board or soldered thereto. In another embodiment, pin tails 206 and shield tails 276 are surface mounted to a printed circuit board.

FIG. 3 shows assembly of the header connectors 100*a*, 100*b* with socket connectors 200*b*, 200*a*, respectively. External guide means such as guide slots 150 or guide pins (not shown) may be provided on the opposite sides of the header connectors 100*a*, 100*b* to guide the insertion of the socket connectors 200*b*, 200*a* into the header connectors 100*a*, 100*b* so that the array of pin-insertion windows 230 in the socket connectors 200*b*, 200*a* are aligned with the array of signal pins 104 in the header connectors 100*a*, 100*b* prior to insertion of the signal pins 104 into mating receptacle contacts 204 of the socket connectors 200*b*, 200*a*. As the socket connectors 200*b*, 200*a* are inserted into the header connectors 100*a*, 100*b*, signal pins 104 of header connectors 100*a*, 100*b* make electrical contact with signal contacts 210 of the socket connectors 200*b*, 200*a*. Depending upon the configuration of shield blades 106 (e.g., whether shield blades 106 extend above internal surface 122 or not), the shield blades 106 of the header connectors 100*a*, 100*b* either make electrical contact with shielding elements 212 of the socket connectors 200*b*, 200*a*, or not. In one embodiment, the plurality of shield blades 106 of the header connectors 100*a*, 100*b* and the at least one shielding element 212 of the socket connectors 200*b*, 200*a* do not make electrical contact when the header connectors 100*a*, 100*b* and the socket connectors 200*b*, 200*a* are in a mated condition. In other embodiments, electrical contact between shield blades 106 of the header connectors 100*a*, 100*b* and the at least one shielding element 212 of the socket connectors 200*b*, 200*a* is provided. If provided, the ground pins 108 of the header connectors 100*a*, 100*b* contact corresponding contact arms 296 or similar structure of socket connectors 200*b*, 200*a*.

In addition to the improved electrical performance provided by controlling the impedance of the signal path as it passes through the printed circuit board 30, the connection system 20 described herein provides other advantages, particularly in assembly of the header connectors 100*a*, 100*b* and attachment to the printed circuit board 30. In one embodiment, shield blades 106 are first inserted into connector bodies 102 of header connectors 100*a*, 100*b*, and the first and second header connectors 100*a*, 100*b* sans pins 104, 108 are aligned with and secured to printed circuit board 30 via shield tails 148. Openings 116, 120 in connector bodies 102 are then used as insertion guides and straighteners for pins 104, 108, thereby reducing the probability of stubbing or otherwise damaging pins 104, 108 during assembly.

In another embodiment, shield blades 106 are inserted into connector bodies 102 of first and second header connectors 100*a*, 100*b*. Pins 104, 108 are inserted only into the connector body 102 of first header connector 100*a* prior to attachment to printed circuit board 30, where they are retained by press fit. The pins 104, 108 and shield tails 148 extending from the first header connector 100*a* are inserted into their corresponding openings 36, 38 in printed circuit board 30, and first header connector 100*a* is secured to first side 32 of printed circuit board 30 via shield tails 148. Second header connector 100*b* is then installed over pins 104, 108 on the opposing side 34 of printed circuit board 30. Finally, second header connector 100*b* is secured to printed circuit board 30 via shield tails 148.

In another embodiment, shield blades 106 are inserted into connector bodies 102 of first and second header connectors 100*a*, 100*b*. Pins 104, 108 are also inserted into connector body 102 of first header connector 100*a* prior to attachment to printed circuit board 30, where they are retained by press fit. Second header connector 100*b* (with shield blades 106) is attached to second side 34 of the printed circuit board 30. The pins 104, 108 and shield tails 148 extending from first header connector 100*a* are then inserted into their corresponding openings 36, 38 from the first side 32 of printed circuit board 30, and guided through the corresponding openings 116, 120 in second header connector 100*b*. First header connector 100*a* is then secured to first side 32 of printed circuit board 30 via shield tails 148.

In each embodiment, chamfered entrances for openings 116, 118, 120 may be provided at one or both of internal surface 122 and external surface 124 of front wall 110 to assist in the insertion of pins 104, 108, and shield blades 106. Chamfered entrances for openings 116, 120 at external surface 124 are particularly useful for capturing pins 104, 108 as they come through circuit board 30.

All plastic parts of header connectors 100*a*, 100*b* and socket connectors 200*a*, 200*b* are molded from suitable thermoplastic material, such as liquid crystal polymer ("LCP"), having the desired mechanical and electrical properties for the intended application. The conductive metallic parts are made from, for example, plated copper alloy material, although other suitable materials will be recognized by those skilled in the art. The connector materials, geometry and dimensions are all designed to maintain a specified impedance throughout the part.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electromechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A connector system comprising:

a circuit board having a plurality of holes extending from a first side of the circuit board to a second side of the circuit board;

a first connector body having a front wall positioned on the first side of the circuit board, the front wall having a plurality of signal pin openings extending therethrough, the signal pin openings aligned with the circuit board holes;

a second connector body having a front wall positioned on a second side of the circuit board, the front wall having a plurality of signal pin openings extending therethrough, the signal pin openings aligned with the circuit board holes; and a plurality of signal pins extending through the signal pin openings of the first and second connector bodies and through the circuit board holes;

wherein at least one of the plurality of circuit board holes has a diameter larger than a diameter of the signal pin extending therethrough, such that walls of the at least one circuit board hole are spaced apart from the signal pin extending therethrough.

2. The connector system of claim 1, wherein the diameter of the at least one circuit board hole is selected such that an impedance between the first and second sides of the circuit board substantially matches an impedance on the first and second sides of the circuit board.

3. The connector system of claim 1, wherein the walls of the at least one circuit board hole are electrically conductive.

4. The connector system of claim 3, further comprising a dielectric material positioned between the electrically conductive walls of the at least one circuit board hole and the signal pin extending therethrough.

5. The connector system of claim 4, wherein the dielectric material is air.

6. The connector system of claim 4, wherein the dielectric material positioned between the electrically conductive walls of the at least one circuit board hole and the signal pin extending therethrough comprises a dielectric coating on the walls of the at least one circuit board hole.

7. The connector system of claim 4, wherein the dielectric material positioned between the electrically conductive walls of the at least one circuit board hole and the signal pin extending therethrough comprises a dielectric coating on the signal pin.

8. The connector system of claim 4, wherein the dielectric material positioned between the electrically conductive walls of the at least one circuit board hole and the signal pin extending therethrough comprises a dielectric sleeve surrounding the signal pin.

9. The connector system of claim 3, wherein the electrically conductive walls of the at least one circuit board hole are electrically connected to a common ground on the circuit board.

10. The connector system of claim 1, further comprising a plurality of shield blades associated with the plurality of signal pins in at least one of the first connector body and second connector body.

11. The connector system of claim 10, wherein the plurality of shield blades are electrically connected to a common ground on the circuit board.

12. The connector system of claim 10, wherein each of the plurality of shield blades comprise a generally right angle shielding portion configured to be disposed adjacent to a corresponding one of the plurality of signal pins.

13. The connector system of claim 10, wherein at least a portion of the shield blades are formed in a continuous strip of material.

14. The connector system of claim 9, wherein at least one of the plurality of signal pins is connected to the common ground on the circuit board.

15. The connector system of claim 1, further comprising:

a socket connector configured to mate with at least one of the first and second connector bodies.

16. The connector system of claim 15, wherein the socket connector is configured for connection with a circuit board.

17. The connector system of claim 15, wherein the socket connector is a cable connector.

18. The connector system of claim 1, wherein the first and second connector bodies each have a longitudinal orientation, and wherein the longitudinal orientation of the first connector body is orthogonal to the longitudinal orientation of the second connector body.

19. The connector system of claim 1, wherein the at least one of the plurality of circuit board holes has two signal pins extending therethrough.

20. The connector system of claim 1, wherein the signal pins are retained within the signal pin openings of at least one of the first and second connector bodies by press-fit.

21. The connector system of claim 1, wherein the signal pins are retained within the signal pin openings of at least one of the first and second connector bodies by slip-fit.

22. The connector system of claim 1, wherein the signal pin openings of the first and second connector bodies are coaxially aligned with the circuit board holes.

23. A method of mounting a connector system to a circuit board comprising:

forming a plurality of holes extending from a first side of the circuit board to a second side of the circuit board;

attaching a first connector body to the first side of the circuit board, the first connector body having a plurality of signal pin openings aligned with the circuit board holes;

attaching a second connector body to the second side of the circuit board opposite the first connector body, the second connector body having a plurality of signal pin openings aligned with the circuit board; and passing signal pins through the aligned circuit board holes and signal pin openings of the first and second header bodies, wherein the circuit board holes are sized such that walls of the circuit board holes are spaced apart from the signal pins.

24. The method of claim 23, further comprising coating walls of the circuit board holes with electrically conductive material, wherein the circuit board holes are sized such that the electrically conductive material on the walls of the circuit board holes is spaced apart from the signal pins.

25. The method of claim 24, further comprising electrically connecting the conductive material on the walls of the circuit board holes to a common ground on the circuit board.

26. The method of claim 23, further comprising sizing the circuit board holes to impedance match the signal pins from the first side of the circuit board to the second side of the circuit board.

27. The method of claim 24, further comprising positioning a non-air dielectric material between the electrically conductive material on the walls of the circuit board holes and the signal pins therein.

28. The method of claim 23, further comprising positioning a plurality of shield blades in at least one of the first and second connector bodies, each of the plurality of shield blades disposed adjacent to a corresponding one of the plurality of signal pins.

29. The method of claim 28, further comprising electrically connecting each of the plurality of shield blades to a ground on the circuit board.

30. A connector system comprising:

a circuit board having a plurality of holes extending therethrough, the holes having electrically conductive walls;

a connector body attached to the circuit board, the connector body having a plurality of signal pin openings and a plurality of shield blade openings, the signal pin openings aligned with the circuit board holes;

a plurality of signal pins retained in the plurality of signal pin openings of the connector body and extending through the circuit board holes; and a plurality of shield blades retained in the plurality of shield blade openings of the connector body, each of the plurality of shield blades having at a first end thereof a generally right angle shielding portion disposed adjacent a corresponding one of the plurality of signal pins;

wherein the circuit board holes are dimensioned such that the electrically conductive walls are spaced apart from the signal pins extending therethrough.

31. The connector system of claim 30, wherein the electrically conductive walls of the circuit board holes and the plurality of shield blades are electrically connected to a common ground.

32. The connector system of claim 30, wherein the dimensions of the circuit board holes are selected such that the impedance through the circuit board substantially matches an impedance of systems on opposite sides of the circuit board.

33. The connector system of claim 30, wherein the generally right angle shielding portions of the plurality of shield blades substantially surround the plurality of signal pins to form a coaxial shield around each of the plurality of signal pins.

34. The connector system of claim 30, further comprising a dielectric material positioned between the electrically conductive walls of the circuit board holes and the corresponding signal pins extending therethrough.

* * * * *

UNITED STATES PATENT AND TRADEMARK OFFICE

CERTIFICATE OF CORRECTION

PATENT NO. : 7,090,501 B1
APPLICATION NO. : 11/086829
DATED : August 15, 2006
INVENTOR(S) : Richard J. Scherer It is certified that error appears in the above-identified patent and that said Letters Patent is hereby corrected as shown below:

Column 4,
Line 12, delete “10b,” and insert -- “100b,” --, therefore.

Column 8,
Lines 15—16, delete “electromechanical,” and insert -- electro—mechanical, --, therefore.

Signed and Sealed this

Twenty-first Day of November, 2006

JON W. DUDAS
*Director of the United States Patent and Trademark Office*